US009137883B2

(12) United States Patent
Sauti et al.

(10) Patent No.: US 9,137,883 B2
(45) Date of Patent: Sep. 15, 2015

(54) ROBUST, FLEXIBLE AND LIGHTWEIGHT DIELECTRIC BARRIER DISCHARGE ACTUATORS USING NANOFOAMS/AEROGELS

(71) Applicants: National Institute of Aerospace Associates, Hampton, VA (US); The United States of America, as represented by the Administrator of the National Aeronautics and Space Administration, Washington, DC (US)

(72) Inventors: Godfrey Sauti, Hampton, VA (US); Tian-Bing Xu, Hampton, VA (US); Emilie J. Siochi, Newport News, VA (US); Stephen P. Wilkinson, Poquoson, VA (US); Mary Ann B. Meador, Strongsville, OH (US); Haiquan N. Guo, Avon, OH (US)

(73) Assignees: NATIONAL INSTITUTE OF AEROSPACE ASSOCIATES, Hampton, VA (US); THE UNITED STATES OF AMERICA AS REPRESENTED BY THE ADMINISTRATOR OF THE NATIONAL AERONAUTICS AND SPACE ADMINISTRATION, Washington, DC (US)

( * ) Notice: Subject to any disclaimer, the term of this patent is extended or adjusted under 35 U.S.C. 154(b) by 0 days.

(21) Appl. No.: 14/287,372

(22) Filed: May 27, 2014

(65) Prior Publication Data

US 2015/0076987 A1 Mar. 19, 2015

Related U.S. Application Data

(60) Provisional application No. 61/855,836, filed on May 24, 2013.

(51) Int. Cl.
*F03H 1/00* (2006.01)
*H05H 1/24* (2006.01)

(52) U.S. Cl.
CPC ..... *H05H 1/2406* (2013.01); *H05H 2001/2412* (2013.01); *H05H 2001/2418* (2013.01)

(58) Field of Classification Search
CPC ..... H05H 1/2406; H05H 2001/2412; H05H 2001/2418
USPC ..... 313/359.1, 360.1, 363.1
See application file for complete search history.

(56) References Cited

FOREIGN PATENT DOCUMENTS

WO WO 2011124419 A1 * 10/2011
WO WO 2012178147 A2 * 12/2012

*Primary Examiner* — Vip Patel
(74) *Attorney, Agent, or Firm* — Kimberly A. Chasteen

(57) ABSTRACT

Robust, flexible, lightweight, low profile enhanced performance dielectric barrier discharge actuators (plasma actuators) based on aerogels/nanofoams with controlled pore size and size distribution as well as pore shape. The plasma actuators offer high body force as well as high force to weight ratios (thrust density). The flexibility and mechanical robustness of the actuators allows them to be shaped to conform to the surface to which they are applied. Carbon nanotube (CNT) based electrodes serve to further decrease the weight and profile of the actuators while maintaining flexibility while insulating nano-inclusions in the matrix enable tailoring of the mechanical properties. Such actuators are required for flow control in aeronautics and moving machinery such as wind turbines, noise abatement in landing gear and rotary wing aircraft and other applications.

17 Claims, 10 Drawing Sheets f = 5 kHz, $V_{pp}$ = 20 kV

ROBUST, FLEXIBLE AND LIGHTWEIGHT DIELECTRIC BARRIER DISCHARGE ACTUATORS USING NANOFOAMS/AEROGELS

CROSS REFERENCE TO RELATED APPLICATION

This application claims the benefit of U.S. Provisional Application No. 61/855,836 filed on May 24, 2013 for "ROBUST, FLEXIBLE AND LIGHTWEIGHT DIELECTRIC BARRIER DISCHARGE ACTUATORS USING NANOFOAMS/AEROGELS."

STATEMENT REGARDING FEDERALLY SPONSORED RESEARCH OR DEVELOPMENT

The invention described herein was made in the performance of work under a NASA cooperative agreement and by employees of the United States Government and is subject to the provisions of Public Law 96-517 (35 U.S.C. §202) and may be manufactured and used by or for the Government for governmental purposes without the payment of any royalties thereon or therefore. In accordance with 35 U.S.C. §202, the cooperative agreement recipient elected to retain title.

BACKGROUND OF THE INVENTION

1. Field of the Invention

The present invention relates to Dielectric Barrier Discharge actuators and more particularly to improved Dielectric Barrier Discharge actuators for aerospace use.

2. Description of Related Art

All references listed in the appended list of references are hereby incorporated by reference, however, as to each of the above, to the extent that such information or statements incorporated by reference might be considered inconsistent with the patenting of this/these invention(s) such statements are expressly not to be considered as made by the applicant(s). The reference numbers in brackets below in the specification refer to the appended list of references.

Dielectric Barrier Discharge (DBD) actuators are surface-mounted, weakly ionized gas (plasma) devices consisting of pairs of electrodes separated by a dielectric and operated at high AC voltages as shown in FIG. 1*a* for a basic DBD and FIGS. 1*b* to 1*d* for new designs being disclosed herein. Devices, such as those shown in FIG. 1*a*, typically operate at frequencies in the range of a few Hz to tens of kHz, the optimum frequency being determined by the permittivity of the dielectric. An AC voltage, typically a few kHz and several kV applied across the dielectric, between the exposed and a buried electrode, generates a plasma on the surface of the dielectric. The plasma is accelerated by the field and imparts momentum to the airflow. A reaction force acts on the actuator in a direction opposite to the airflow. The electrically charged dielectric surface attracts charged ions in the air plasma, imparting momentum to the non-ionized air through many molecular collisions. Increasing the surface charge magnitude and/or increasing the ion density in the air plasma can increase momentum exchange to create an aerodynamic body force that accelerates neutral gas in the vicinity of the plasma for boundary layer flow control including separation control. One of the limitations of DBD performance is the lack of optimum dielectric materials, with current materials being ad hoc selections of readily available, high dielectric breakdown strength materials. Early devices were mostly made from thin, high dielectric strength materials such as Kapton® and the bulk of the work in the field focused on understanding the underlying plasma physics. More recently (last ten years), there has been an increase in interest in the devices for flow control in various applications and materials including glass, (PTFE) Teflon®, acrylic and ceramics such as alumina ($Al_2O_3$) have been used. Teflon®, with a dielectric constant of 2.1 and dielectric breakdown strength of 20 kV/mm is one of the top performing state-of-the-art materials. Actuators made of thick (several mm) Teflon® have been used to generate thrusts of the order 0.25 N/m of actuator at 25 kV rms [Ref. 1]. In all of the state-of-the-art materials, the force generated is seen to increase with an increase in the applied voltage, but above a certain threshold, which depends on the type and thickness of the dielectric material, the rate of increase is seen to decrease and then drop off Fine et al. [Ref 2] demonstrated that a titanium dioxide ($TiO_2$) catalyst could be used to enhance the body force generated by $Al_2O_3$ actuators. More recently, Durscher and Roy [Ref. 3] have demonstrated that actuators made of silica aerogels form high performance but very brittle actuators.

The potential for this technology to enable new flight applications and significant improvements in flight vehicle concepts can be realized with materials designed for increased body forces that also provide higher force to weight ratios and improved robustness. Body force is equal to the product of the local electric field strength and net electric charge density in the ionized flow. The total force from a DBD device further depends on the total length (and thus area) of the device. Increasing the applied electric field, charge density and device length increases force, thereby enables a wider Reynolds number range of potential flight applications, from increased airfoil stall angles to improved jet engine turbine blade performance. The ideal actuator has high charge density, a dielectric material that supports high electric fields for charge acceleration and that is lightweight so the actuator can be applied over large areas while adding minimal weight. The actuator must also be of a low profile to enable easy installation without negatively affecting the airflow or requiring highly invasive modifications to the surface to which it is mounted. Furthermore, the dielectric material must be mechanically robust and chemically stable in order to be able to survive plasma over the surface, as well as harsh application environments, for extended periods. These include vibrations, high temperatures and contact with potentially damaging fluids and vapors such as those from jet fuel and hydraulic fluids in aviation applications.

The structure of DBD devices requires that electrodes be bonded onto the surfaces of the dielectric and therefore, the material should be amenable to this bonding for stable actuator performance.

It has been shown in the literature [Ref 4] that the ideal dielectric to increase force generation would have a low dielectric constant, near unity, (that of typical polymers ranges from 2-8 while those of bulk inorganic materials typically range from 4 and above) and a high breakdown strength (many kilovolts per millimeter) to enable ionization of the air. Additionally a low dielectric loss reduces heat generation in the dielectric, at the frequencies at which DBD actuators operate, and thus increases energy conversion efficiency and a catalytic layer to enhance the charge density in the air adjacent to the surface [Ref. 5].

It is a primary object of the present invention to provide an improved DBD actuator.

It is an object of the invention to provide an improved DBD actuator which has high charge density.

It is an object of the invention to provide an improved DBD actuator which has a dielectric material that supports high electric fields for charge acceleration.

It is an object of the invention to provide an improved DBD actuator that is lightweight so the actuator can be applied over large areas while adding minimal weight.

It is an object of the invention to provide an improved DBD actuator having a low profile to enable easy installation without negatively affecting the airflow or requiring highly invasive modifications to the surface to which it is mounted.

It is an object of the invention to provide an improved DBD actuator which has a dielectric material that is mechanically robust and chemically stable in order to be able to survive plasma over its surface.

It is an object of the invention to provide an improved DBD actuator functional in harsh application environments, such as vibrations, high temperatures and contact with potentially damaging fluids and vapors such as those from jet fuel and hydraulic fluids in aviation applications, for extended periods.

Finally, it is an object of the present invention to accomplish the foregoing objectives in a simple and cost effective manner.

The above and further objects, details and advantages of the invention will become apparent from the following detailed description, when read in conjunction with the accompanying drawings.

SUMMARY OF THE INVENTION

The present invention addresses these needs by providing a dielectric barrier discharge actuator, which includes a dielectric layer produced from lightweight, high breakdown strength, low dielectric constant and loss flexible polymeric aerogel, a buried electrode buried within the dielectric layer and an exposed electrode located on the surface of the dielectric, wherein the buried electrode and the exposed electrode are electrically connected. The polymeric aerogel is preferably a high temperature polyimide, and more preferably is 50% ODA/50% DMBZ and BPDA with OAPS crosslinks. The dielectric layer may be fluorinated and may be 25% 6FDA/75% ODA and BPDA with TAB crosslinks. The polymeric aerogel may be reinforced with low loss, low dielectric constant fillers such as boron nitride nanotubes, nanoparticles, nano sheets or combinations thereof. The polymeric aerogel may be doped with a catalytic nano inclusion that enhances its surface charge generation wherein the dopant is a material with a high secondary electron emission coefficient or a radioisotope, which on decay promotes surface charge generation. Only the top surface of the aerogel may be doped while the catalytic nano inclusion is undoped. The electrodes may include carbon nanotubes, preferably, in the form of a tape and, preferably, which are doped with copper, iodine, bromine, silver, gold or nickel. Preferably, the carbon nanotube electrode is doped with a catalytic nano inclusion that enhances the surface charge generation, with a material with a high secondary electron emission coefficient or with a radioisotope which on decay promotes surface charge generation.

BRIEF DESCRIPTION OF THE DRAWINGS

A more complete description of the subject matter of the present invention and the advantages thereof, can be achieved by reference to the following detailed description by which reference is made to the accompanying drawings in which.

ELEMENT LIST

Figure 1A:
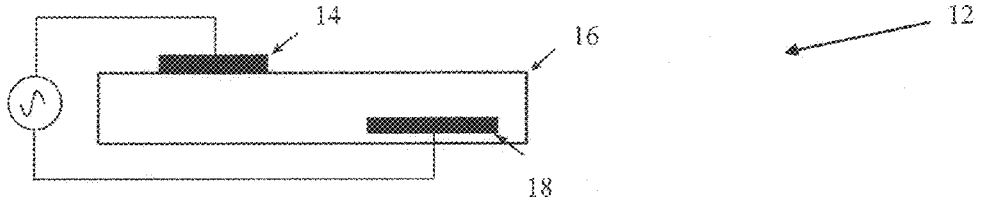
Figure 1a Prior Art
FIG. 1*a* shows a schematic of a dielectric barrier discharge (DBD) actuator.
Figure 1B:
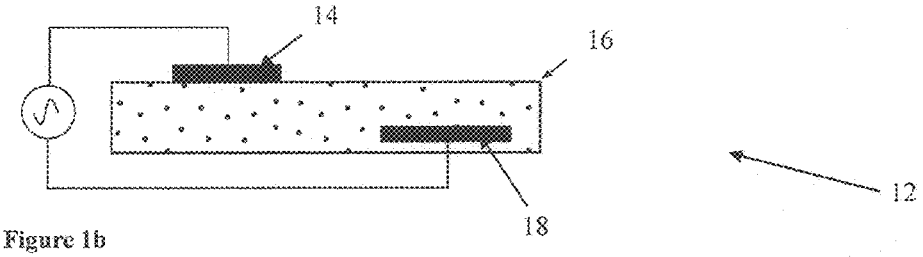
FIG. 1*b* shows a schematic of a robust, flexible, lightweight actuator according to the present innovation with an ultra low dielectric constant and loss, high dielectric breakdown strength nanofoam/aerogel for the dielectric.
Figure 1C:
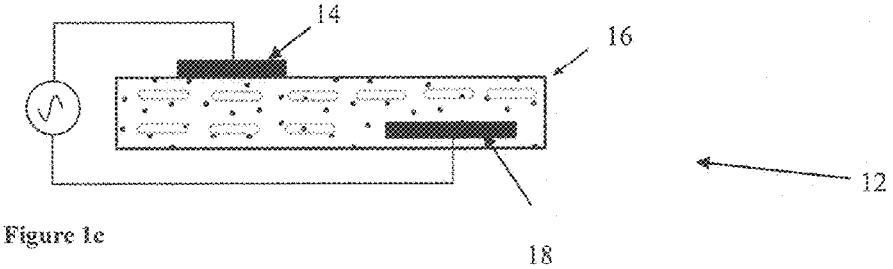
FIG. 1*c* shows a schematic of a robust, flexible, lightweight actuator according to the present innovation with a nano inclusion reinforced dielectric.
Figure 1D:
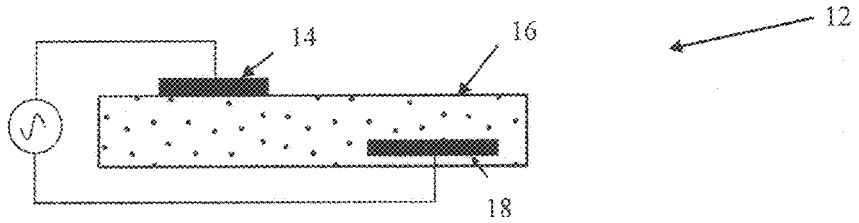
FIG. 1*d* shows that further actuator weight savings and additional robustness and performance gains are obtained by replacing copper based electrodes with carbon nanotube based materials, such as sheets and tapes as one or both of the electrodes.

12 dielectric barrier discharge actuator
14 exposed electrode
16 dielectric

18 buried electrode
19 surface layer of the dielectric
20 bulk of the dielectric
21 airfoil

DETAILED DESCRIPTION OF THE PREFERRED EMBODIMENT

The following detailed description is of the best presently contemplated mode of carrying out the invention. This description is not to be taken in a limiting sense, but is made merely for the purpose of illustrating general principles of embodiments of the invention. The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

The present invention describes DBD actuators 12 where the dielectric materials are nanofoams/aerogels with controlled porosity to achieve normally mutually exclusive properties of ultra-low dielectric constant and high dielectric breakdown strength. For a material to function as a DBD actuator 12, a very high electric field must be applied to ionize the air and accelerate the charged particles. This requires that the dielectric sustain an applied field of the order of many kV/mm. High porosity is required to attain low dielectric constants. The dielectric constant tends to one ($\in \rightarrow 1$) as the total volume of empty space increases.

The present invention obtains ultra-low dielectric constants through the use of high porosity (>80%) nanofoams/aerogels, and high dielectric breakdown strength by ensuring that the empty volume is made up of pores with diameters in the nanometer range. Such small diameters prevent the acceleration of charge carriers required for breakdown [Ref 8]. By specifically combining matrix material selection and the incorporation of porosity at the nanoscale with controlled pore size/shape and size distribution as well as the distribution of these pores within the matrix (spherical, narrow size range and evenly dispersed to prevent electrical stress buildup), these unique requirements for DBD actuators 12 can be attained.

Figure 3A:
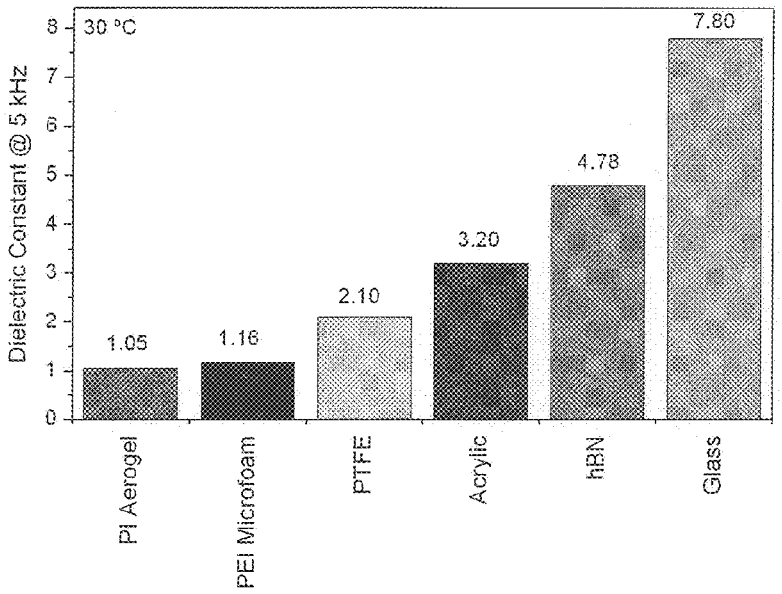
FIG. 3*a* shows the dielectric constant at 30° C. and 5 kHz (the actuator test frequency).
Figure 3B:
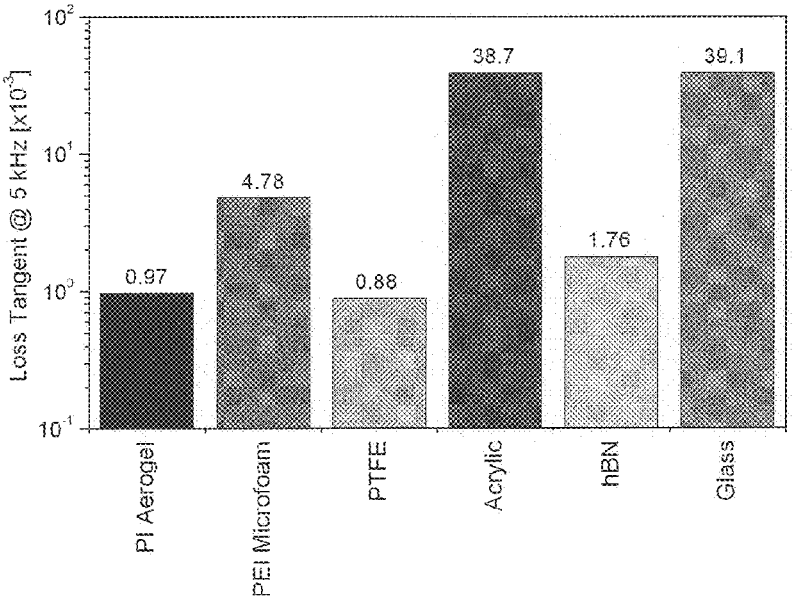
FIG. 3*b* shows the loss tangent at 30° C. and 5 kHz (the actuator test frequency)

FIGS. 2 and 3 show the dielectric constants and loss tangents of polyimide (PI)aerogel, a polyetherimide (PEI) microfoam and some state-of-the-art DBD materials near room temperature (30° C.) and at 120° C. FIG. 2 shows the frequency dependence of the dielectric constant and loss tangent while FIG. 3 shows them at 30° C. and an actuator test frequency (5 kHz). The aerogel and microfoam have the lowest dielectric constants, approaching 1.0 and these remain stable both as a function of the frequency and temperature, a desirable attribute for practical actuator performance. The foams also have very low losses with that of the aerogel being second only to that of PTFE (Teflon®), a very low loss dielectric. Note that in addition to the porosity, the loss can be controlled by selection of the aerogel/nanofoam matrix. The high temperature stability conferred to the aerogels by use of the polyimide matrix (glass transition temperature ($T_g$)>200° C.) leads to the very small changes in the dielectric properties between room temperature and 120° C. and ensures that these materials can function as plasma actuator dielectrics over a wide temperature range. By selection of a fluorinated polyimide matrix, it is expected that the loss of the aerogel will be lowered even further while maintaining a wide service temperature range.

Figure 4A:
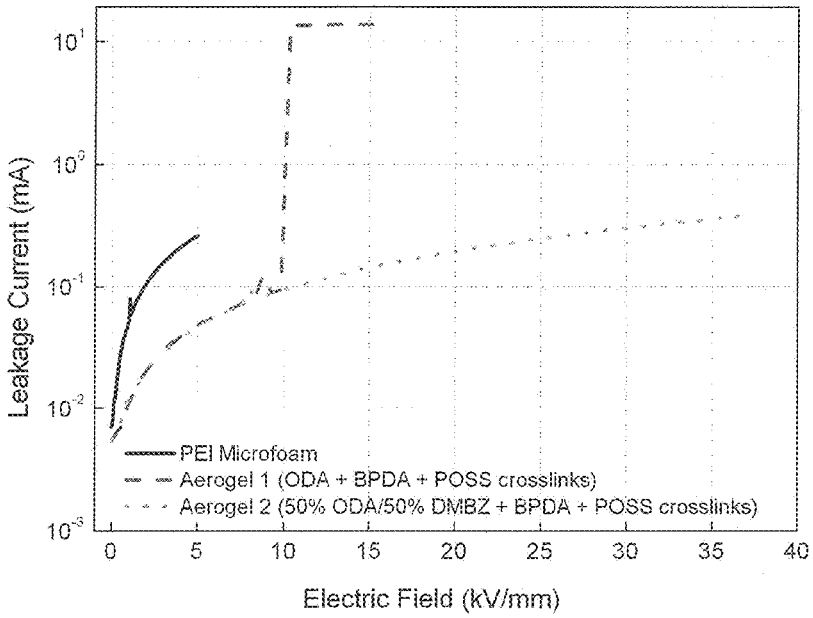
FIG. 4*a* shows leakage current vs electric field for some porous dielectrics.
Figure 4B:
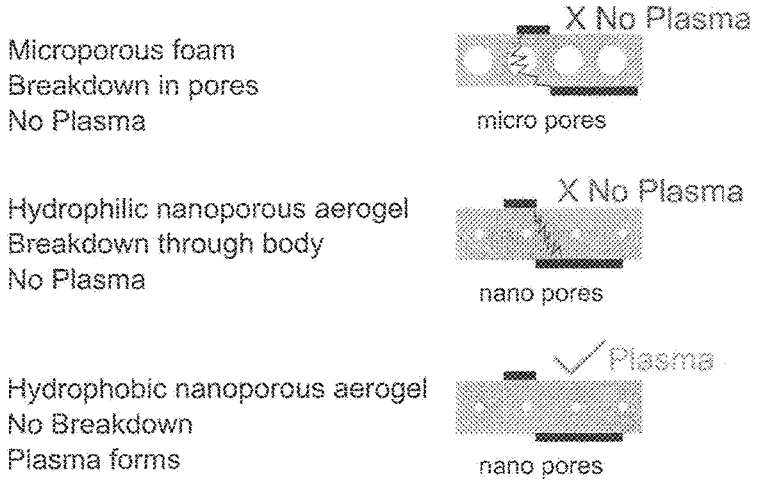
FIG. 4*b* shows the requirements for plasma formation in porous dielectrics.
Figure 5:
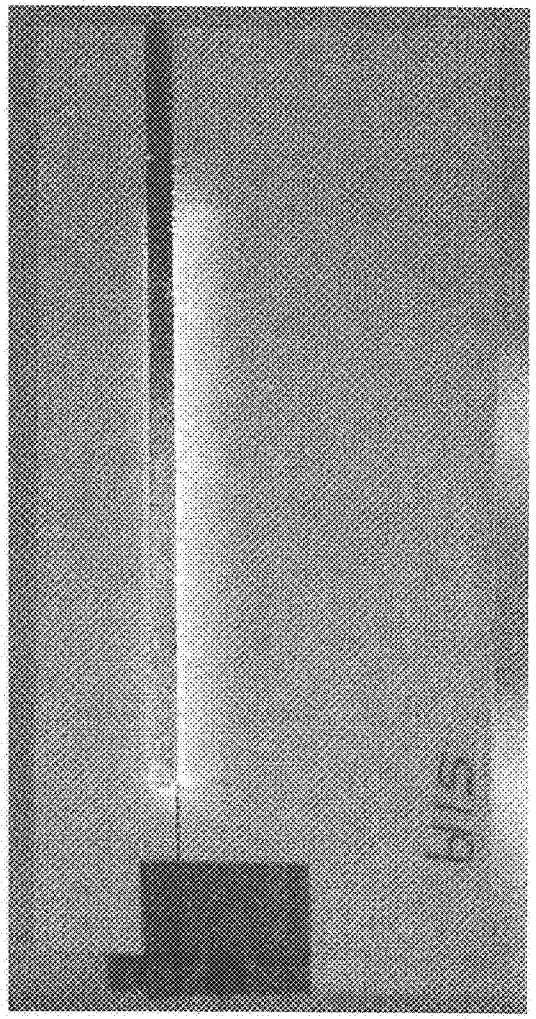
FIG. 5 shows plasma generated on a robust, flexible and lightweight, polymer aerogel actuator.

FIG. 4 shows the leakage current (an indicator of dielectric breakdown and energy loss) as a function of the applied electric field in a test conducted according to ASTM D149-09 "Standard Test Method for Dielectric Breakdown Voltage and Dielectric Strength of Solid Electrical Insulating Materials at Commercial Power Frequencies"). The choice of the DBD dielectric material affects the dielectric breakdown strength and hence the ability to act as an actuator 12. The figure shows the properties of a polyetherimide (PEI) microfoam, a highly flexible aerogel containing hydrophilic chemical groups (4,4'-oxidianiline (ODA) and biphenyl-3,3',4,4'-tetracarboxylic dianhydride (BPDA) with octa(aminophenyl)silsesquioxane (OAPS), a polyhedral oligomer silesquioxane (POSS)), a slightly more rigid but still flexible and hydrophobic formulation (50% ODA/50% 2,2'-dimethylbenzidine (DMBZ) and BPDA with OAPS crosslinks). Breakdown within the pores of the PEI microfoam leads to large leakage currents below the field required to produce a plasma. The hydrophilic (ODA and BPDA with OAPS crosslinks) aerogel also breaks down (rapid increase in the leakage current) at a much lower field than the hydrophobic formulation ((50% ODA/50% 2,2'-dimethylbenzidine (DMBZ) and BPDA with OAPS crosslinks). The microfoam, though having a low dielectric constant, has a high leakage current and low dielectric breakdown strength due to discharges within the pores. With suitable selection of the chemistry, a hydrophobic aerogel is formulated with pore sizes and a matrix that prevent breakdown and sustain the generation of a plasma (FIG. 5). A fluorinated aerogel 25% 2,2-bis(3,4-dicarboxyphenyl) hexafluoropropane dianhydride (6FDA)/75% ODA and BPDA with 1,3,5-triaminophenoxybenzene (TAB) crosslinks was also found to be suitable for plasma actuator applications.

Figure 6:
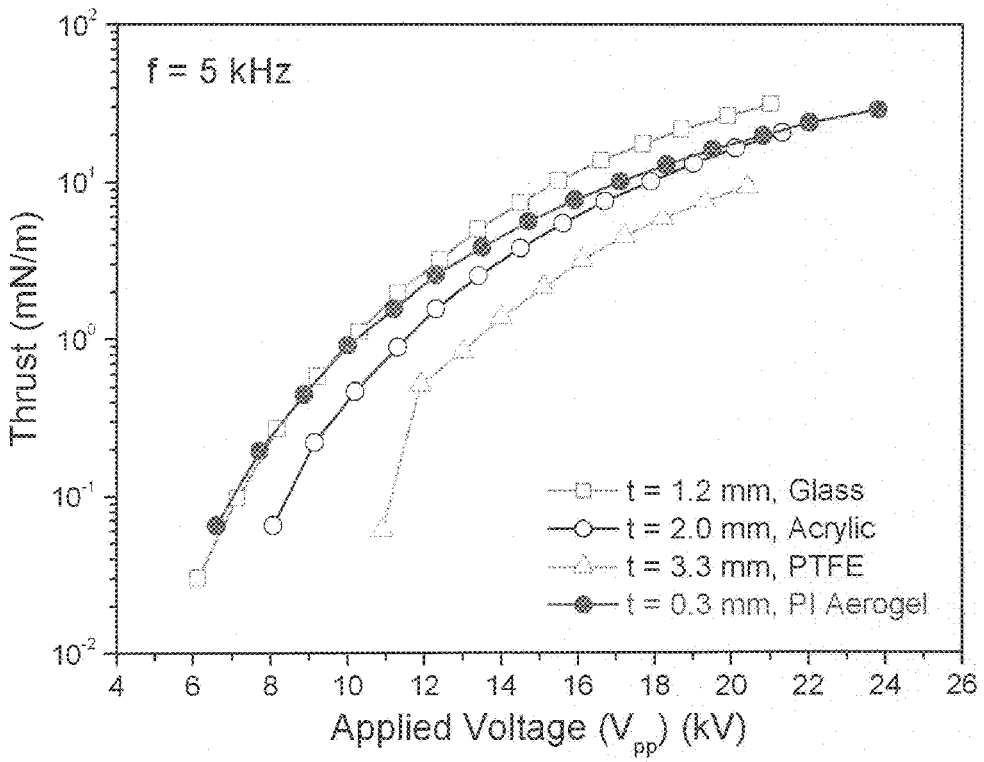
FIG. 6 shows thrust generated by a thin (low profile) robust, flexible polyimide aerogel actuator vs. applied voltage compared to some state of the art thick dielectric materials.

FIG. 6 shows the thrust vs applied voltage for a low profile aerogel actuator compared to some state-of-the-art (thick dielectric) actuators at a common test frequency (5 kHz). It can be seen that not only can a plasma be sustained by the flexible aerogel, but the material generates a thrust that compares with and in cases exceeds the state-of-the-art. Enhanced force can be obtained by tuning the test frequency to the device's characteristic frequency and, as the actuator saturation voltage has not been reached (instrument limit), by increasing the applied voltage.

Figure 7:
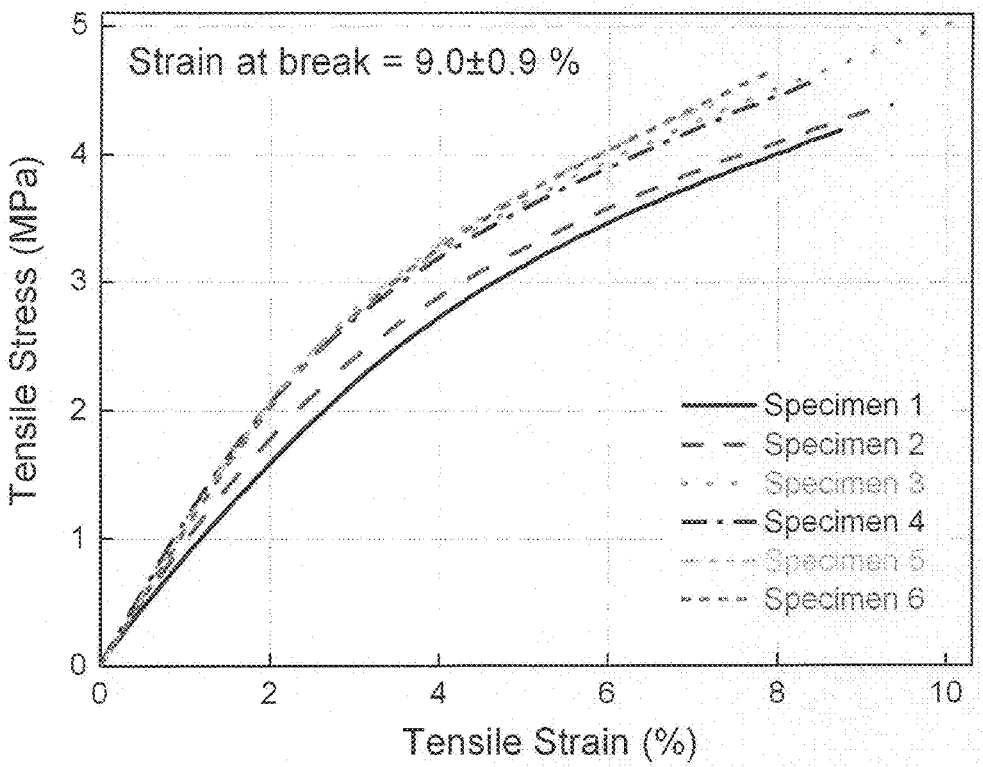
FIG. 7 shows tensile test data for a high dielectric strength, hydrophobic, flexible, lightweight aerogel material for DBD actuator construction.

FIG. 7 shows the mechanical properties of the polymeric aerogel material. These materials are robust, far exceeding very brittle silica based aerogels, with tensile strengths of 4.6 MPa and strain at break in close to 10%. This is in contrast to inorganic silica based aerogels that are highly brittle and friable. For applications requiring greater mechanical and thermal performance, such as stiffer or more damage tolerant actuators or higher temperature environments, the aerogel matrix is preferably reinforced with electrically insulating, low dielectric constant and loss fillers such as boron nitride nanotubes (BNNTs) with electrical properties similar to hexagonal Boron Nitride (hBN) ($\in \rightarrow 4.8$ and tan $\delta \sim 2\times10^{-4}$ at 5 kHz).

Figure 8:
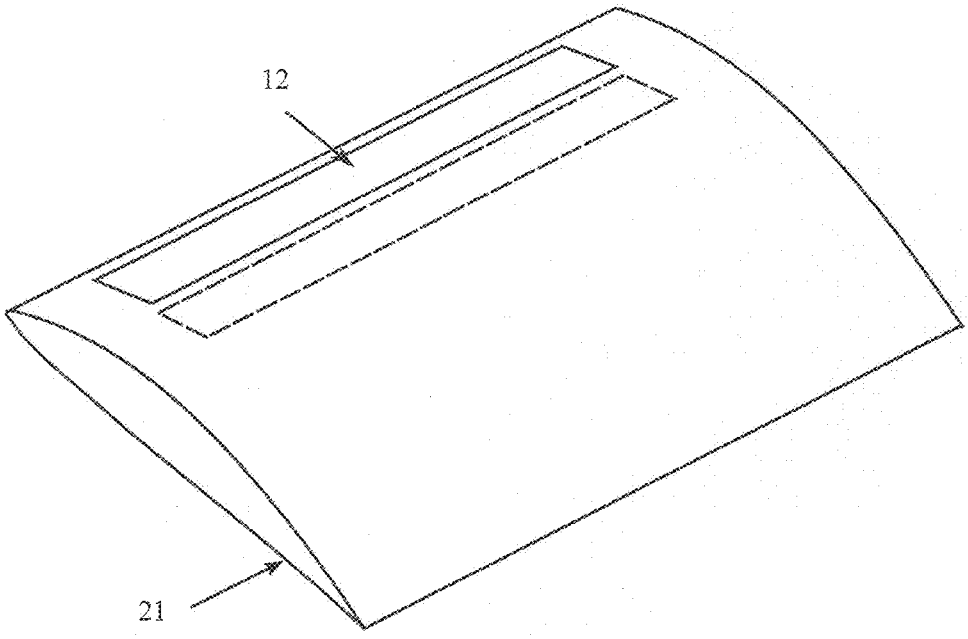
FIG. 8 shows flexible, light weight, low profile DBD actuators as applied over large areas of airfoils.
Figure 9A:
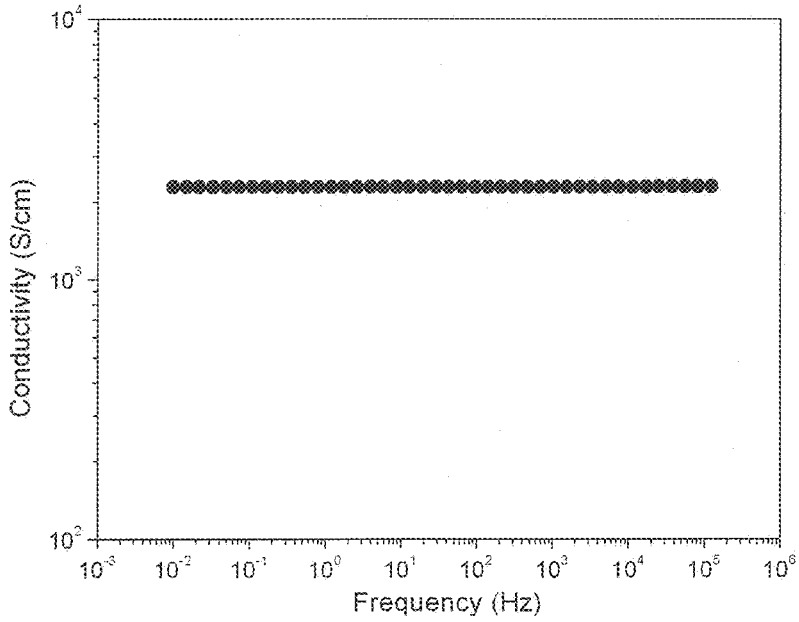
FIG. 9*a* shows the AC conductivity of a 20 μm thick CNT tape electrode approaches 3000 S/cm over a broad frequency range.
Figure 9B:
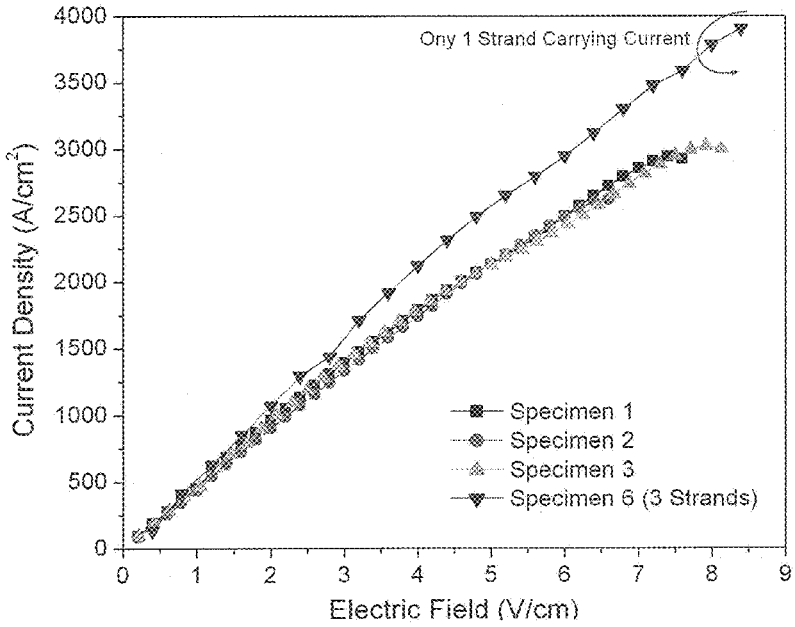
FIG. 9*b* shows DC conductivity tests that show a CNT yarn can sustain current densities much higher than would be expected for DBDs that are largely voltage driven devices.

For high control authority, DBD actuators 12 may require application over relatively large areas and in strategic locations so the total force and effect on the flow is increased (FIG. 8). Flexible, light weight, low profile DBD actuators 12 can be applied over large areas of airfoils 21, providing increased forces and therefore control authority at a minimal weight penalty and invasive modification to the surface to which they are applied. DBD actuators 12 can be used to control flow separation, noise abatement and other aerodynamic functions. When applied over these large areas, the weight can become significant. To minimize the contribution of the electrodes 14,18 to the actuator weight, carbon nanomaterials are used as the electrodes 14,18. Aerogel/CNT sheet actuators are preferred in robust, flexible, low profile and lightweight actuators. The density of CNTs is approximately 1.3 g/cm$^3$ while those of copper and gold are 8.96 g/cm$^3$, and 19.30 g/cm$^3$ respectively. In some applications, CNT yarns are already replacing copper cabling because of the huge weight savings gained. Carbon nanotube based materials have good high frequency conductivity that for doped, highly purified and defect free tubes is greater than aluminum and copper [Ref. 10]. The carbon nanotubes are preferably doped with copper, iodine, bromine, silver, gold or nickel to enhance the electrical conductivity while maintaining low weight. Conductivities continue to improve as material preparation processes are being refined. FIG. 9 shows the AC conductivity of a CNT tape electrode 14,18 and the current density for a CNT yarn. The conductivity of state-of-the-art, routinely produced, CNT material already exceeds 3000 S/cm and the current density sustained is higher than would be required for these voltage driven devices. Carbon nanotube based electrodes 14,18 are very flexible/conformable to surfaces allowing them to be readily applied to curved surfaces. The superior mechanical properties of carbon nanomaterials may mean longer lifetimes for applications where the actuator, and thus electrode 14,18, may suffer mechanical deformations or fatigue inducing vibrations. Carbon nanotube derived electrodes 14,18, including modified CNTs have chemical characteristics and in particular secondary electron emission coefficients that are different from copper which changes the boundary conditions for the plasma generation in the DBD actuator 12, an important parameter in their performance [Ref. 11]. Numerous processes of modifying the CNT electrodes 14,18, including doping, electrochemical means, supercritical fluid infusion and microwave assisted metal deposition are already described in the literature.

Figure 10:
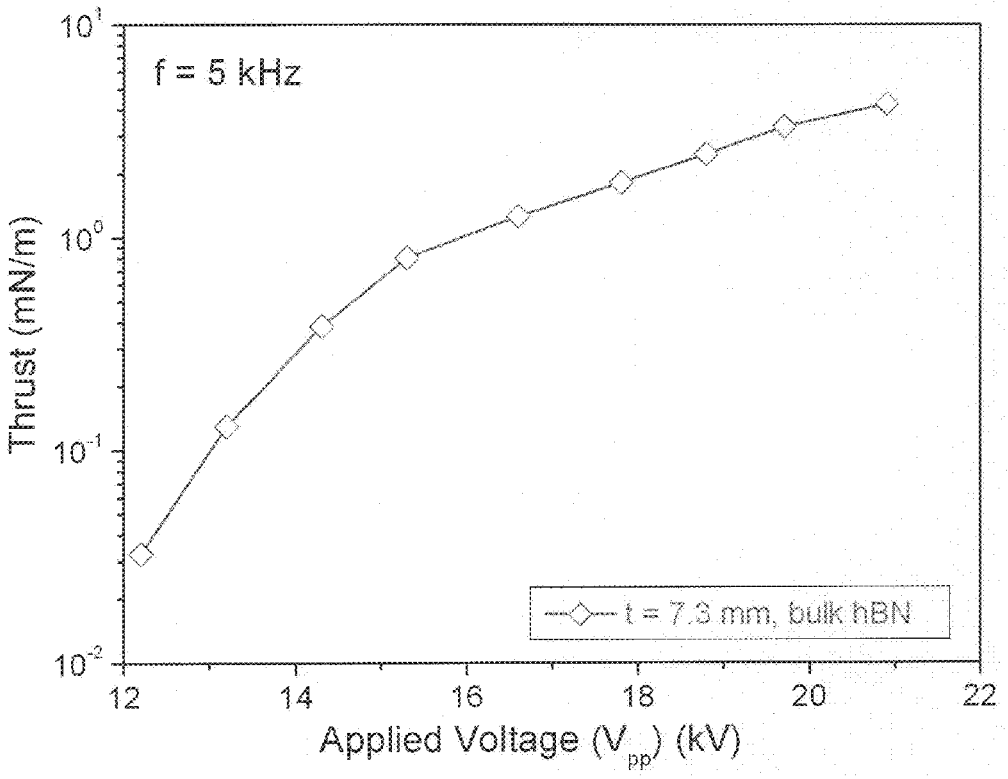
FIG. 10 shows thrust vs the applied voltage for bulk hexagonal boron nitride.

For practical applications, a DBD actuator 12 needs to be robust as well as have temperature, plasma and environmental resistance. FIG. 4 shows the leakage current as a function of the applied voltage, for two flexible aerogel materials. The more hydrophobic material allows a higher electric field to be generated without a catastrophic increase in the leakage current and therefore forms a basis for a DBD actuator 12. Control of the chemistry of the dielectric thus allows for high performance actuators that are able to withstand the application environment. Furthermore, the chemistry and surface morphology of the actuator are most preferably such that it promotes adhesion of the electrodes 14,18 for long actuator lives. Surface texturing can be used to promote adhesion of the electrodes 14,18 to the surface 19. Polyimides and fluorinated polymers are able to withstand a range of environments in which DBD actuators 12 may be used. Thus, polyimides and fluorinated aerogels which include fluorinated polyimide aerogels, form a suitable material for high performance DBD actuators 12. For high temperature applications actuators can be constructed out of inert materials such as boron nitride and aerogels with BN as a matrix. Bulk hBN is known to be a high dielectric strength material and it is shown in FIGS. 2 and 3 that it has a relatively low dielectric constant and loss. FIG. 10 shows the thrust generated by a bulk hBN actuator at test voltages well below the saturation voltage. A plasma is sustained and using BN nanofoams and aerogels as well as operation at higher voltages increases the thrust further while maintaining the environmental and chemical resistance. For harsh environments, robust lightweight actuators can be constructed from, and nanofoams/aerogels based on, hexagonal boron nitride whose bulk dielectric 20 properties are shown in FIGS. 2 and 3 and thrust vs the applied voltage is shown in FIG. 10.

Figure 1E:
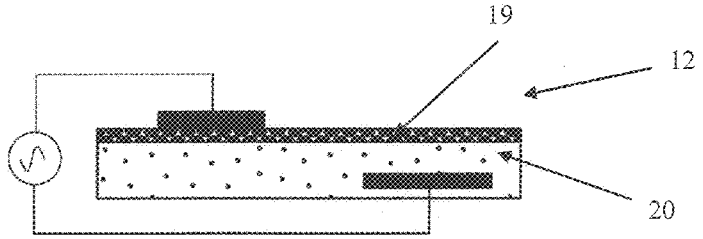
FIG. 1*e* shows that the actuator performance can be further enhanced by doping the top (surface) layer with catalysts that enhance plasma formation while leaving the bulk unmodified.
Figure 2A:
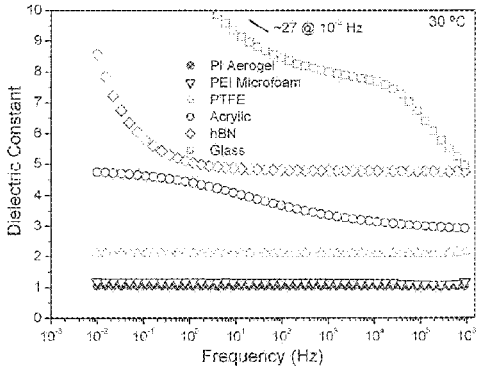
FIG. 2*a* shows the frequency dependence of the real dielectric constant at 30° C. for a flexible polymeric aerogel, bulk hexagonal Boron Nitride (hBN) and some common DBD materials.
Figure 2B:
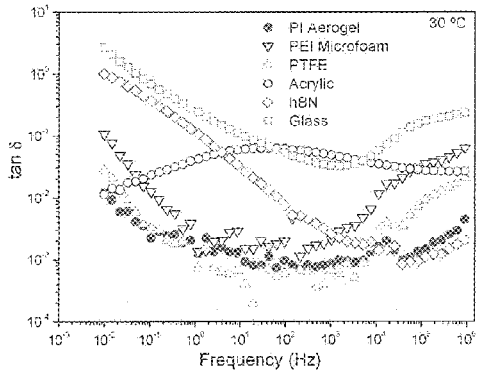
FIG. 2*b* shows the frequency dependence of the loss tangent (tan δ) at 30° C. for a flexible polymeric nanofoam/aerogel, bulk hexagonal Boron Nitride (hBN) and some common DBD materials.
Figure 2C:
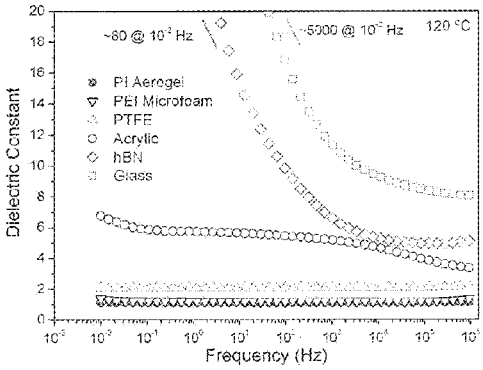
FIG. 2*c* shows the frequency dependence of the real dielectric constant at 120° C. for a flexible polymeric aerogel, bulk hexagonal Boron Nitride (hBN) and some common DBD materials.
Figure 2D:
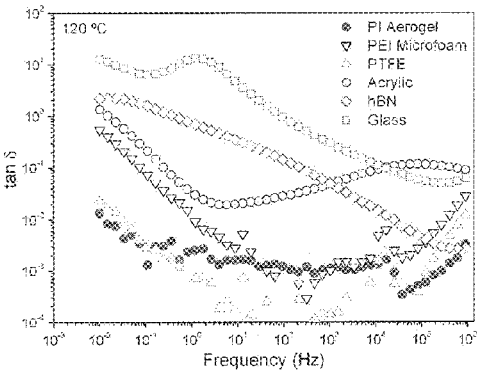
FIG. 2*d* shows the frequency dependence of the loss tangent (tan δ) at 120° C. for a flexible polymeric aerogel, bulk hexagonal Boron Nitride (hBN) and some common DBD materials.

Many of the physical characteristics of the aerogels/nanofoams, such as thermal, acoustic and mechanical properties, are well known and it has been demonstrated that they have very low and tailorable dielectric constants ($\in \approx 1$). The present invention relates to the development of robust, flexible, lightweight materials for DBD actuators 12 with enhanced performance by controlling the chemical nature of the matrix, pore size, shape and size distribution. The chemical properties of the nanofoam/aerogel matrix described above are preferably tailored to optimize DBD and mechanical performance, as well as endurance of the application environment. For applications requiring highly robust actuators, the aerogel matrix is preferably reinforced with insulating nanoinclusions such as boron nitride nanotubes. It is known that hBN, a chemical analogue of BNNTs, has a low dielectric constant and loss, enabling the formation of a plasma. Yet more robust actuators, for harsh environments, including high temperatures are preferably formulated from aerogels/nanofoams with hBN as the matrix material. An alternate embodiment is the use of carbon nanotube and graphene nanosheet based electrodes 14,18 for ultra-light weight actuators. Carbon based nanomaterials (carbon nanotubes and graphene sheets) are excellent electrical conductors, particularly at high frequencies. Macroscopic forms of these such as tapes and sheets preferably form the electrodes 14,18 for a lightweight DBD actuator 12. The nanotube material is used as one or both the electrodes 14,18, depending on the application and desired electrode lifetime. Additives to enhance the conductivity or act as catalyst are infused into the carbon based electrode material as desired. The CNT (and modified CNT) electrode 14,18 provides a chemically different electrode from copper changing the boundary conditions (secondary electron emission coefficient) for the plasma generation, an important performance parameter, in potentially advantageous ways. Similarly, the nanofoam/aerogel dielectric 16 and in particular the top surface 19 can be doped/infused with a catalytic material that enhances surface charge generation while the bulk 20 is unmodified to retain the low dielectric constant and high dielectric breakdown strength as shown in FIG. 1*e*. Such catalyst include radioisotopes and materials with high secondary electron emission coefficients such as sodium chloride (NaCl) and hydrogen terminated (H-terminated) diamond.

Obviously, many modifications may be made without departing from the basic spirit of the present invention. Accordingly, it will be appreciated by those skilled in the art that within the scope of the appended claims, the invention may be practiced other than has been specifically described herein. Many improvements, modifications, and additions will be apparent to the skilled artisan without departing from the spirit and scope of the present invention as described herein and defined in the following claims.

LIST OF REFERENCES

[Ref. 1] Thomas F. O., Corke T. C., Iqbal M., Kozlov A. and Scahtzman D., "Optimization of dielectric barrier discharge actuators for active aerodynamic flow control", AIAA Journal, Vol. 47, no. 9, 2009

[Ref. 2] Neal E. Fine and Steven J. Brickner "Plasma Catalysis for Enhanced-Thrust Single Dielectric Barrier Discharge Plasma Actuators," AIAA Journal, Vol. 48 no. 12, 2010, pp. 2979-2982

[Ref 3] Durscher, Ryan and Roy, Subrata, "Aerogel and Ferroelectric Dielectric Materials for Plasma Actuators," J. Phys. D: Appl. Phys., 2012, 45, 012001

[Ref 4] Thomas F. O., Corke T. C., Iqbal M., Kozlov A. and Scahtzman D., "Optimization of dielectric barrier discharge actuators for active aerodynamic flow control", AIAA J., v. 47, n. 9, September, 2009

[Ref 5] Fine and Brickner, "Plasma Catalysis for Enhanced-Thrust Single Dielectric Barrier Discharge Plasma Actuators," AIAA Journal, Vol. 48 no. 12, 2010, pp. 2979-2982

[Ref 6] Corke, Thomas C., Post, Martiqua L. and Orlov, Dmitriy M., "Single Dielectric Barrier Discharge Plasma Enhanced Aerodynamics: Physics, Modeling and Applications," Exp. Fluids, 2009, 46, 1-26

[Ref 7] Corke, Thomas C., Enloe, C. Lon and Wilkinson, Stephen P., "Dielectric Barrier Discharge Plasma Actuators for Flow Control," *Annual Rev. Fluid Mech.,* 2010, 42, 505-29 [Ref 8] Hrubesh, L. W, "Aerogels for Electronics," presented at Technology 2004 NASA, Washington, D. C., Nov. 6-9, 1994

[Ref. 9] Zito, J. C., Durscher, R. J., Soni, J., Roy, S. and Arnold, D. P.: "Flow and Force Inducement Using Micron Size Dielectric Barrier Discharge Actuators", *Applied Physics Letters,* 2012, 100, 193502

[Ref 10] Zhao, Y., Wei, J., Vajtai, R., Ajayan, P. M. & Barrera, E. V. "Iodine doped carbon nanotube cables exceeding specific electrical conductivity of metals." Sci. Rep. 1, 83; DOI:10.1038/srep00083 (2011)

[Ref 11] Alexandre V. Likhanskii, Mikhail N. Shneider, Sergey O. Macheret, and Richard B. Miles "Modeling of dielectric barrier discharge plasma actuator in air" J. Appl. Phys. 103, 053305 (2008)

What is claimed is:

1. A dielectric barrier discharge actuator, comprising:

a dielectric layer produced from lightweight, high breakdown strength, low dielectric constant and loss flexible polymeric aerogel;

a buried electrode buried within the dielectric layer; and an exposed electrode located on the surface of the dielectric, wherein the buried electrode and the exposed electrode are electrically connected.

2. The dielectric barrier discharge actuator of claim 1 wherein the polymeric aerogel is a high temperature polyimide.

3. The dielectric barrier discharge actuator of claim 2 wherein the high temperature polyimide is composed of 50% ODA/50% DMBZ and BPDA with OAPS crosslinks.

4. The dielectric barrier discharge actuator of claim 1 wherein the dielectric layer is fluorinated.

5. The dielectric barrier discharge actuator of claim 4 wherein the fluorinated dielectric layer consists of 25% 6FDA/75% ODA and BPDA with TAB crosslinks.

6. The dielectric barrier discharge actuator of claim 1 wherein the polymeric aerogel is reinforced with low loss, low dielectric constant fillers.

7. The dielectric barrier discharge actuator of claim 1 wherein the polymeric aerogel is reinforced with a filler selected from the group consisting of boron nitride nanotubes, nanoparticles, nano sheets and any combination thereof.

8. The dielectric barrier discharge actuator of claim 1 wherein the polymeric aerogel is doped with a catalytic nano inclusion that enhances its surface charge generation.

9. The dielectric barrier discharge actuator of claim 8 wherein the dopant is a material with a high secondary electron emission coefficient.

10. The dielectric barrier discharge actuator of claim 8 wherein the dopant is a radioisotope, which on decay promotes surface charge generation.

11. The dielectric barrier discharge actuator of claim 8 wherein only the top surface of the aerogel is doped and wherein the catalytic nano inclusion is undoped.

12. The dielectric barrier discharge actuator of claim 1 wherein the one or more of the electrodes includes carbon nanotubes.

13. The dielectric barrier discharge actuator of claim 12 wherein the electrode which includes carbon nanotubes is in the form of a tape.

14. The dielectric barrier discharge actuator of claim 12 wherein the carbon nanotubes are doped with elements from the group consisting of copper, iodine, bromine, silver, gold and nickel.

15. The dielectric barrier discharge actuator of claim 12 wherein the carbon nanotube electrode is doped with a catalytic nano inclusion that enhances the surface charge generation.

16. The dielectric barrier discharge actuator of claim 12 wherein the carbon nanotubes are doped with a material with a high secondary electron emission coefficient.

17. The dielectric barrier discharge actuator of claim 12 wherein the carbon nanotubes are doped with a radioisotope which on decay promotes surface charge generation.

* * * * *